US010707568B2

(12) United States Patent
Tseng

(10) Patent No.: US 10,707,568 B2
(45) Date of Patent: Jul. 7, 2020

(54) ANTENNA STRUCTURE

(71) Applicant: WISTRON NEWEB CORPORATION, Hsinchu (TW)

(72) Inventor: Shih-Hsien Tseng, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 0 days.

(21) Appl. No.: 16/357,580

(22) Filed: Mar. 19, 2019

(65) Prior Publication Data

US 2019/0379110 A1 Dec. 12, 2019

(30) Foreign Application Priority Data

Jun. 8, 2018 (TW) ..... 107119820 A

(51) Int. Cl.

| | |
|---|---|
| ***H01Q 1/50*** | (2006.01) |
| ***H01Q 1/36*** | (2006.01) |
| ***H01Q 5/335*** | (2015.01) |
| ***H01Q 5/328*** | (2015.01) |
| ***H01Q 1/48*** | (2006.01) |

(52) U.S. Cl.

CPC ..... *H01Q 1/36* (2013.01); *H01Q 1/48* (2013.01); *H01Q 5/328* (2015.01); *H01Q 5/335* (2015.01)

(58) Field of Classification Search

CPC .. H01Q 1/24; H01Q 1/36; H01Q 1/48; H01Q 1/50; H01Q 5/328; H01Q 5/335

See application file for complete search history.

(56) References Cited

U.S. PATENT DOCUMENTS

2010/0309070 A1 12/2010 Wong et al.
2014/0320359 A1 10/2014 Wong et al.
2015/0022419 A1* 1/2015 Chang ..... H01Q 5/50 343/852

FOREIGN PATENT DOCUMENTS

TW 201044695 A 12/2010
TW I536669 B 6/2016

OTHER PUBLICATIONS

C.-Y. Huang and P.-Y. Chiu, "Dual-band monopole antenna with shorted parasitic element" Electronics Letters, Oct. 13, 2005, vol. 41, No. 21.

* cited by examiner

*Primary Examiner* — Hoang V Nguyen

(74) *Attorney, Agent, or Firm* — McClure, Qualey & Rodack, LLP

(57) ABSTRACT

An antenna structure includes a substrate, a first radiating element, a second radiating element, a signal transmission assembly, a grounding member, and a feed-in element. The first radiating element is disposed on the substrate. The second radiating element is disposed on the substrate. The signal transmission assembly is disposed on the substrate. The signal transmission assembly includes a signal transmission line, a first impedance matching circuit, and a filter. The signal transmission assembly is coupled between the first radiating element and the second radiating element. The first impedance matching circuit is coupling to the first radiating element and the signal transmission line. The filter is coupling to the second radiating element and the signal transmission line. The feed-in element is coupled between the signal transmission line and the grounding member.

18 Claims, 15 Drawing Sheets

ANTENNA STRUCTURE

CROSS-REFERENCE TO RELATED PATENT APPLICATION

This application claims the benefit of priority to Taiwan Patent Application No. 107119820, filed on Jun. 8, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the present disclosure described herein. All references cited and discussed in this specification are incorporated herein by reference in their entireties and to the same extent as if each reference was individually incorporated by reference.

FIELD OF THE PRESENT DISCLOSURE

The present disclosure relates to an antenna structure, and more particularly to an antenna structure capable of adjusting impedance matching and having filtering functions.

BACKGROUND OF THE PRESENT DISCLOSURE

With the increasing popularity of portable electronic devices (such as smart phones, tablets, and notebook computers), more attention has been directed to wireless communication technology for portable electronic devices in recent years. The quality of wireless communication depends on the efficiency of an antenna in the electronic device. Therefore, how the radiation performance (such as gain) of an antenna can be improved has become quite an important issue in the art.

Further, although some existing antenna architectures (for example, a planar inverted-F antenna (PIFA)) can generate multiple frequency bands, the space for holding an antenna in such a product has been greatly reduced in size due to the recent trend of product miniaturization. With such a reduced space, different frequency bands will affect each other, resulting in a lower matching effect for antennas.

Furthermore, although U.S. Patent Publication No. 20140320359A1 discloses a "communication device and antenna element therein," which utilizes a first matching circuit and a second matching circuit to adjust an impedance value, the antenna therein is separately connected to a communication module, resulting in cost increase. Further, with the advent of the next generation communication technology 5G Licensed Assisted Access (LAA), the design therein does not meet the needs of the application frequency band of a fifth generation communication system.

SUMMARY OF THE PRESENT DISCLOSURE

In response to the above-referenced technical inadequacies, the present disclosure provides an antenna structure.

In one aspect, the present disclosure provides an antenna structure including a substrate, a first radiating element disposed on the substrate, a second radiating element disposed on the substrate, a signal transmission assembly disposed on the substrate and including a signal transmission line, a first impedance matching circuit and a filter, a grounding member, and a feed-in element coupled between the signal transmission line and the grounding member. The signal transmission line is coupled between the first radiating element and the second radiating element. The first impedance matching circuit is coupling to the first radiating element and the signal transmission line. The filter is coupling to the second radiating element and the signal transmission line Therefore, the antenna structure provided by the present disclosure can not only achieve a multi-band effect with a single feed-in element, but also reduce the overall area of the antenna structure and improve the radiation performance (such as gain) of the antenna by the technical features of "a signal transmission line coupled between the first radiating element and the second radiating element," "a first impedance matching circuit coupling to the first radiating element and the signal transmission line," "a filter coupling to the second radiating element and the signal transmission line," and "the feed-in element coupled between the signal transmission line and the grounding member."

These and other aspects of the present disclosure will become apparent from the following description of certain embodiments taken in conjunction with the following drawings and their captions, although variations and modifications therein may be affected without departing from the spirit and scope of the novel concepts of the present disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
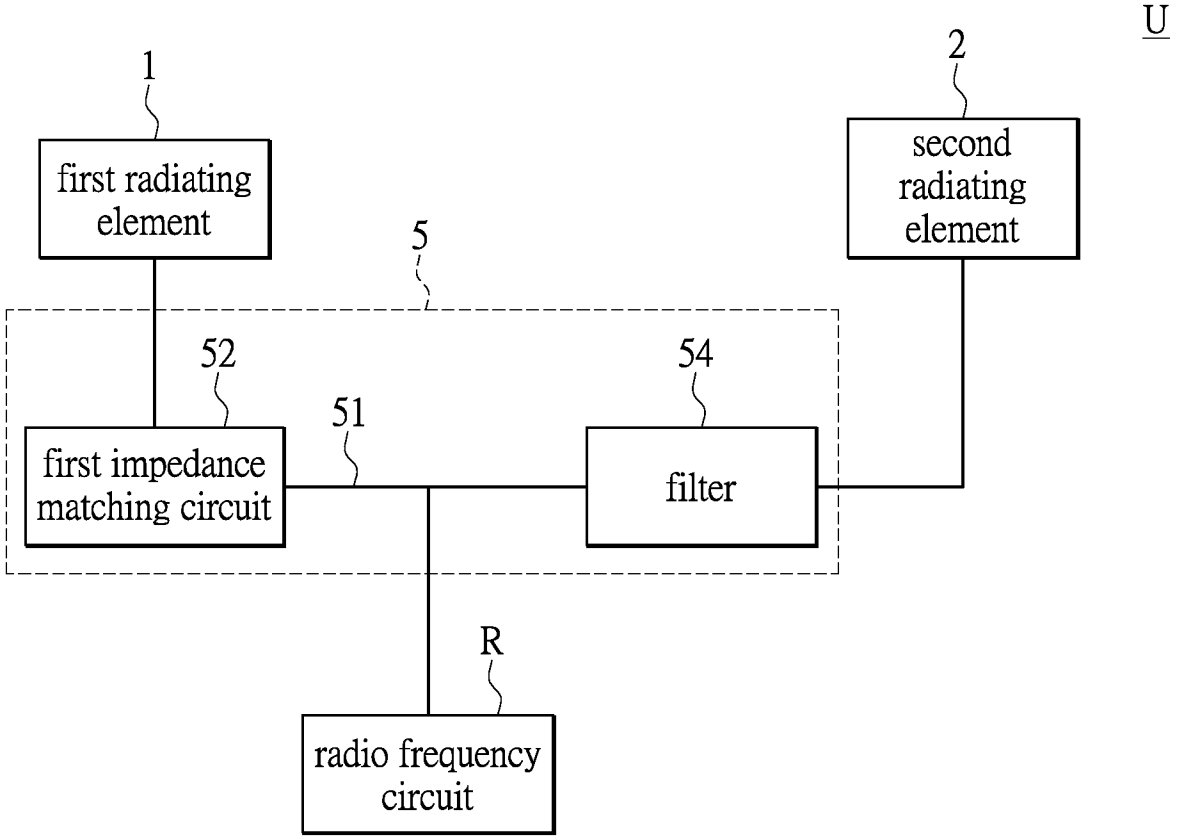
FIG. 1 is a functional block diagram of an antenna structure according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
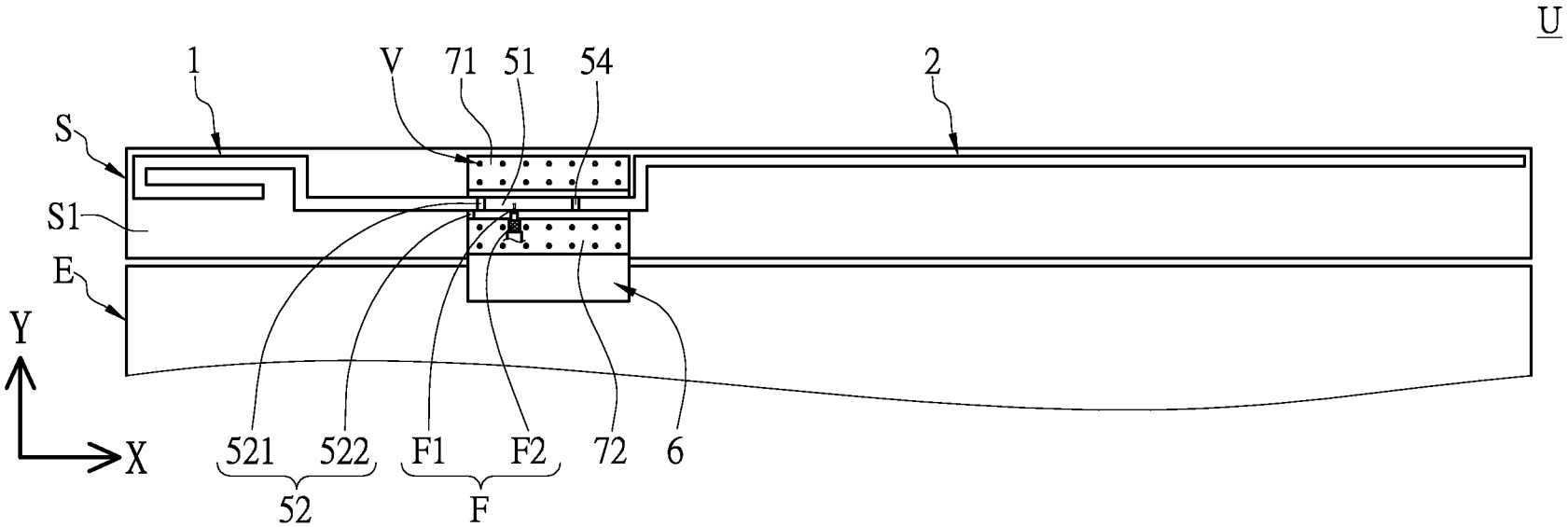
FIG. 2 is a top view of the entire antenna structure according to the first embodiment of the present disclosure.
Figure 3:
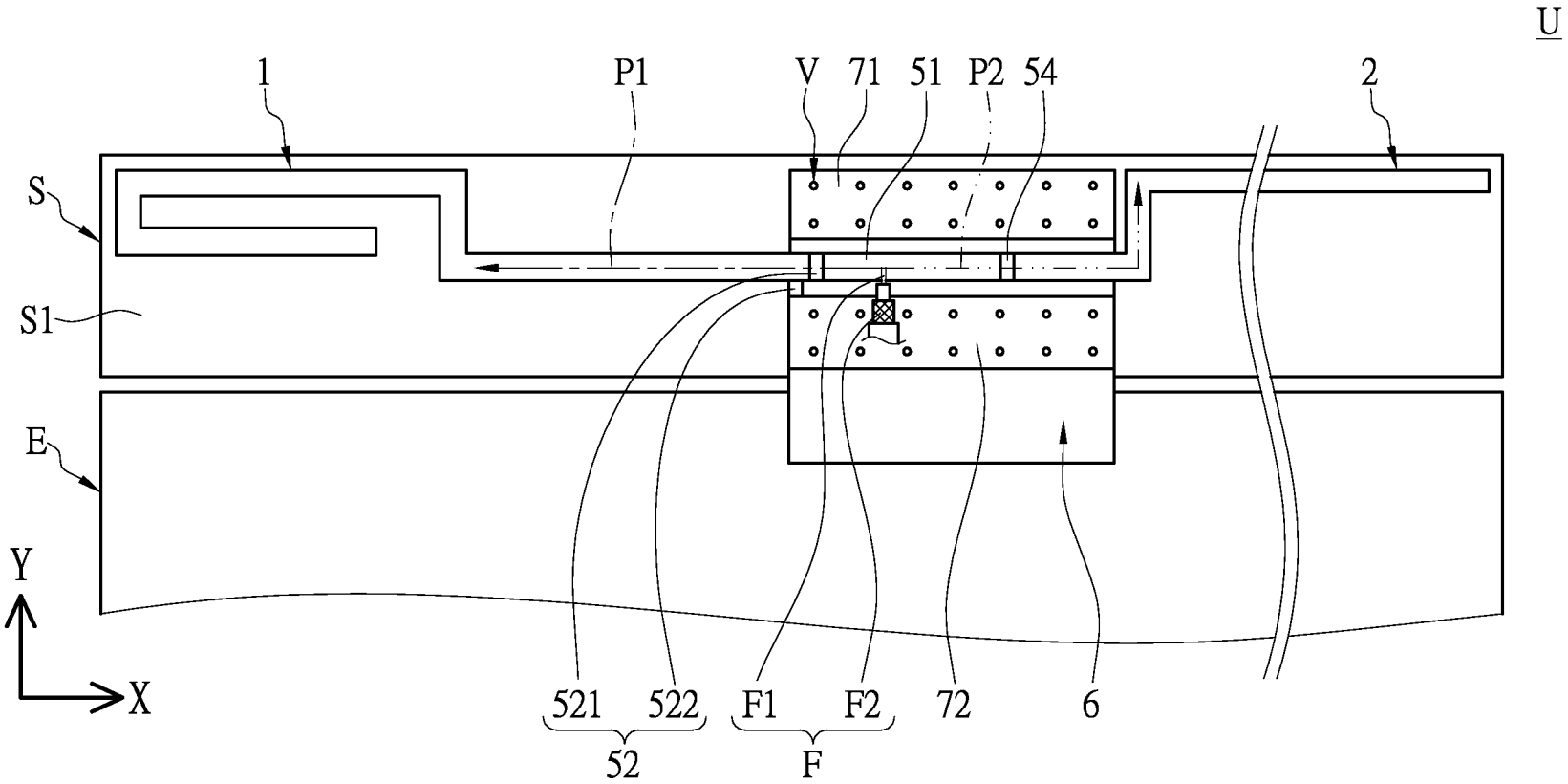
FIG. 3 is another top view of the antenna structure according to the first embodiment of the present disclosure.

First, reference is made to FIG. 1 to FIG. 3. FIG. 1 is a functional block diagram of an antenna structure U according to a first embodiment of the present disclosure. FIG. 2 is a top view of the entire antenna structure U according to the first embodiment of the present disclosure. FIG. 3 is another top view of the antenna structure U according to the first embodiment of the present disclosure. In order to present the figures in an easily understandable way, while FIG. 2 shows the complete structure of the antenna structure U, break lines are used in other figures. Specifically, the present disclosure provides an antenna structure U including a substrate S, a first radiating element 1, a second radiating element 2, a signal transmission assembly 5, a grounding member 6, and a feed-in element F. The first radiating element 1, the second radiating element 2, and the signal transmission assembly 5 may be disposed on the substrate S. For example, the first radiating element 1 and the second radiating element 2 may be a metal piece, a metal wire or other conductive bodies having a conductive effect, and the substrate S may be a printed circuit board (PCB). However, the present disclosure is not limited to the above examples. In addition, in other embodiments, the antenna structure U may further include a metal conductor E. The grounding member 6 may be coupled to the metal conductor E. For example, the metal conductor E may be a back cover structure of a notebook computer. However, the present disclosure is not limited thereto.

Further, referring again to FIG. 1 to FIG. 3, the signal transmission assembly 5 can include a signal transmission line 51, a first impedance matching circuit 52, and a filter 54. The signal transmission line 51 can be coupled between the first radiating element 1 and the second radiating element 2, the first impedance matching circuit 52 can be coupled to the first radiating element 1 and the signal transmission line 51, and the filter 54 can be coupled to the second radiating element 2 and the signal transmission line 51. For example, the impedance value of the signal transmission assembly 5 can be 50 ohms. In addition, the feed-in element F can be coupled between the signal transmission line 51 and the grounding member 6 to feed in a signal. Further, in certain embodiments, the antenna structure U is coupling to a radio frequency (RF) circuit R through the feed-in element F to transmit the signal between the antenna structure U and the radio frequency circuit R through the feed-in element F. For example, the RF circuit R can be a radio frequency chip, but the present disclosure is not limited thereto.

Further, referring again to FIG. 3, the feed-in element F can have a feeding end F1 and a grounding end F2. The feeding end F1 of the feed-in element F can be coupled to the signal transmission line 51. The junction (not labeled in the figure) between the feeding end F1 and the signal transmission line 51 may be located between the first impedance matching circuit 52 and the filter 54. In addition, the grounding end F2 of the feed-in element F can be coupled to the grounding member 6. For example, the feed-in element F can be a coaxial cable, but the present disclosure is not limited thereto. In addition, it should be noted that the coupling in the present disclosure may be a direct connection or an indirect connection, or a direct electrical connection or an indirect electrical connection, and the present disclosure is not limited thereto.

Figure 4:
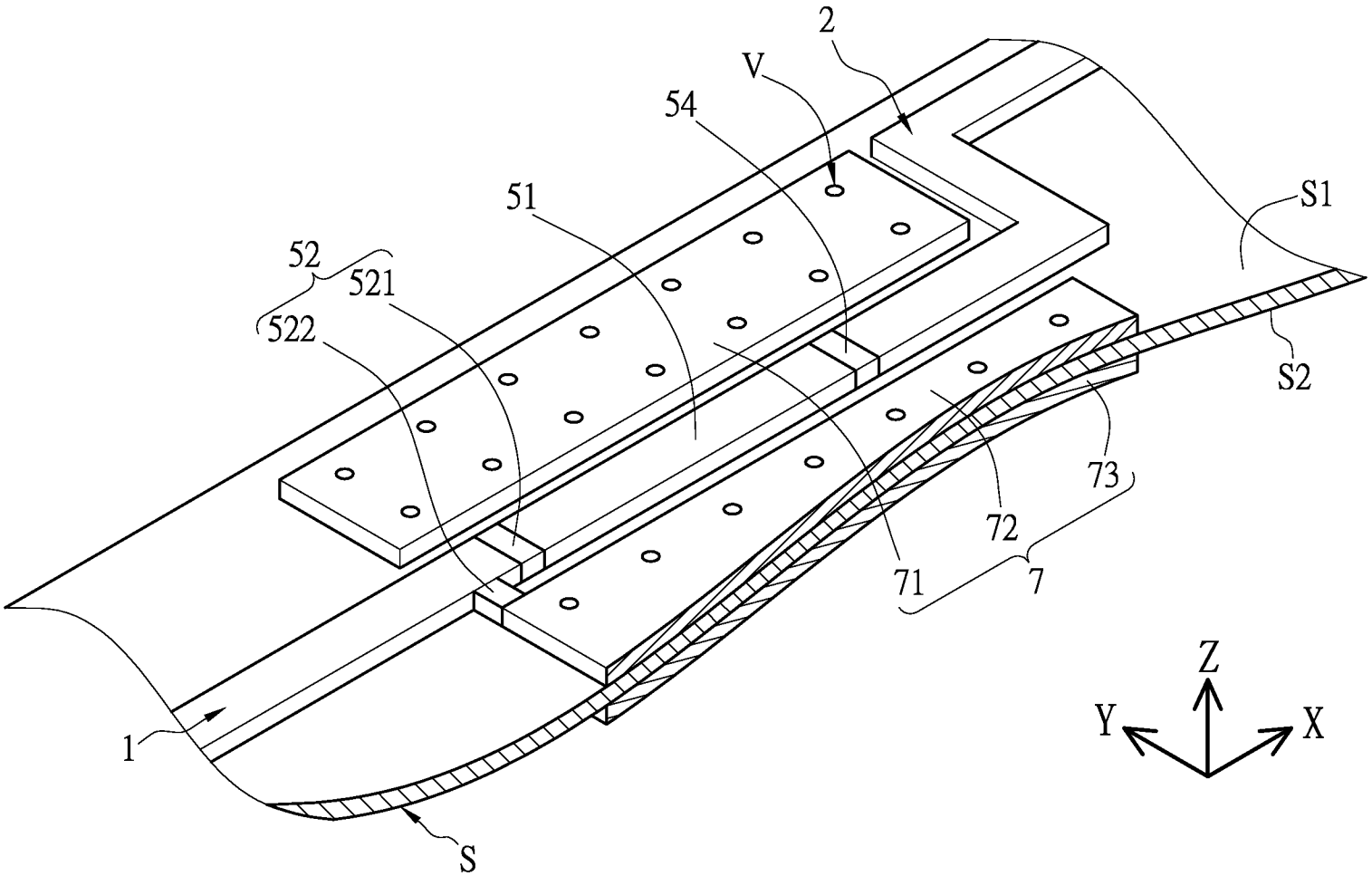
FIG. 4 is a partial perspective cross-sectional view of the antenna structure according to the first embodiment of the present disclosure.
Figure 5:
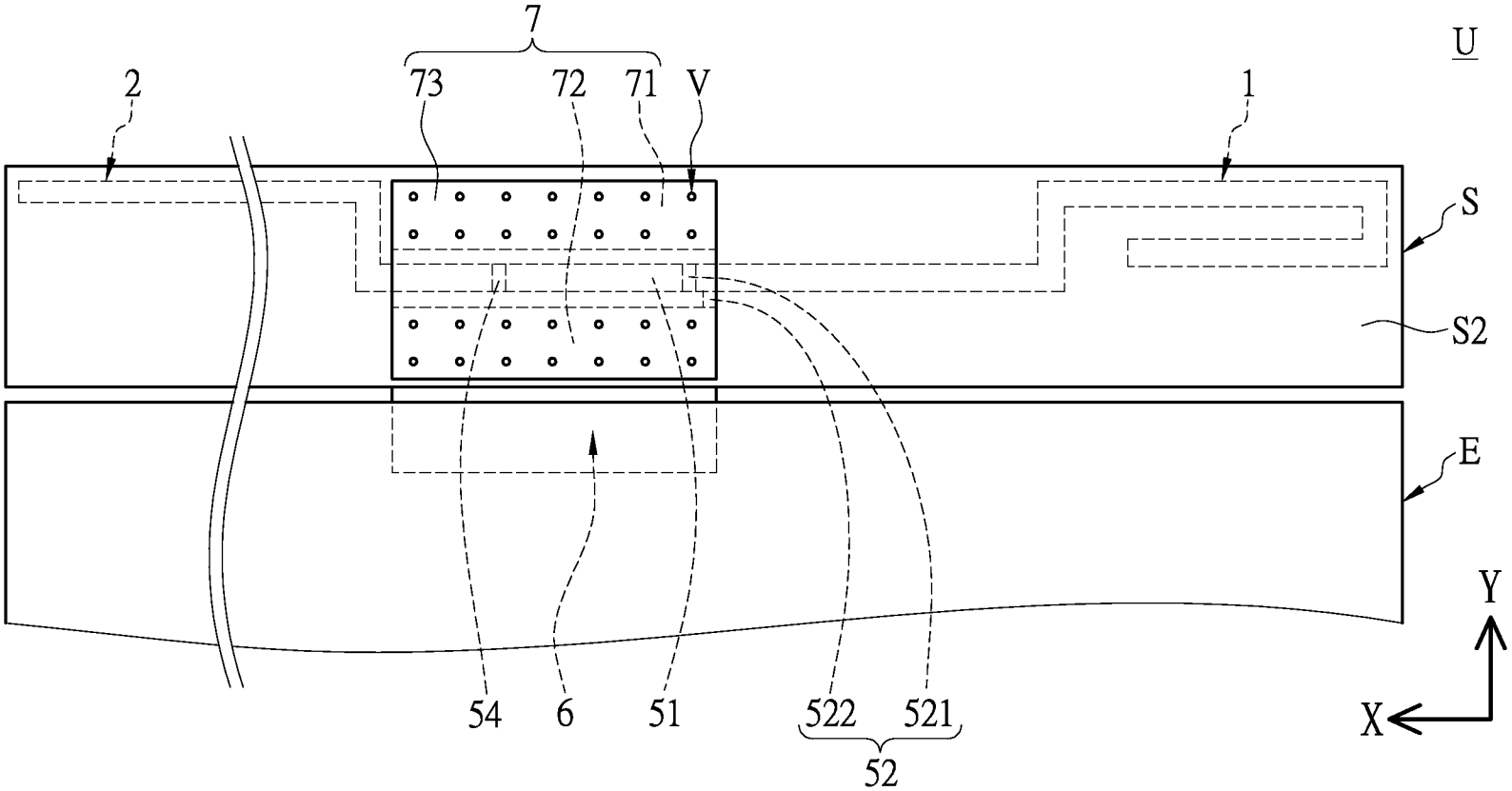
FIG. 5 is a bottom view of the antenna structure according to the first embodiment of the present disclosure.

Reference is made to FIG. 3, FIG. 4 and FIG. 5. FIG. 4 is a partial perspective cross-sectional view of the antenna structure U according to the first embodiment of the present disclosure. FIG. 5 is a bottom view of the antenna structure U according to the first embodiment of the present disclosure. Specifically, the antenna structure U may further include a grounding metal member 7 (which may otherwise be referred to as a third grounding metal layer 73). The substrate S may have a first surface S1 and a second surface S2 opposite to the first surface S1. The signal transmission assembly 5 can be disposed on the first surface S1, the grounding metal member 7 (the third grounding metal layer 73) can be disposed on the second surface S2. The vertical projection (i.e., in the Z-axis direction) of the grounding metal member 7 (the third grounding metal layer 73) on the substrate S overlaps at least partially with the vertical projection of the signal transmission assembly 5 on the substrate S. In other words, the signal transmission assembly 5 is disposed in a non-clearance area (not labeled). In certain embodiments, the first impedance matching circuit 52 and the filter 54 of the signal transmission assembly 5 are completely disposed in the non-clearance area. In other words, if there is a grounding metal (for example, the third grounding metal layer 73) in a region formed by the vertical projection of the signal transmission assembly 5 with respect to the substrate S, the region can be defined as a non-clearance area. That is, as shown in FIG. 5, the area formed by the vertical projection of the third grounding metal layer 73 with respect to the substrate S is a non-clearance area. In addition, it should be noted that, in certain embodiments, the first radiating element 1 and the second radiating element 2 may be located in a clearance area.

Referring again to FIG. 3 to FIG. 5, in certain embodiments, the grounding metal member 7 can be coupled to the grounding member 6, and the grounding metal member 7 can further include a first grounding metal layer 71 and a second grounding metal layer 72. The third grounding metal layer 73 is coupled between the first grounding metal layer 71 and the second grounding metal layer 72. The signal transmission assembly 5, the first grounding metal layer 71 and the second grounding metal layer 72 may be disposed on the first surface S1 of the substrate S, and the third grounding metal layer 73 may be disposed on the second surface S2 of the substrate S to form a grounded coplanar waveguide (GCPW). Thereby, the first impedance matching circuit 52 and the filter 54 of the signal transmission assembly 5 can be disposed on the GCPW. In addition, for example, the substrate S may be a dielectric layer in a double-sided FR-4 copper foil substrate, whereby the signal transmission line 51, the first grounding metal layer 71, and the second grounding metal layer 72 may be a copper foil on one of the surfaces of the copper foil substrate, and the third grounding metal layer 73 can be a copper foil on the other surface of the copper foil substrate. However, the present disclosure is not limited thereto. In addition, the second grounding metal layer 72 can be coupled to the grounding member 6, and the grounding end F2 of the feed-in element F can be coupled to the second grounding metal layer 72, so that the grounding end F2 of the feed-in element F is coupling to the grounding member 6 through the second grounding metal layer 72. However, the present disclosure is not limited thereto. That is, in other embodiments, the grounding member 6 can also be coupled to the first grounding metal layer 71 or the third grounding metal layer 73. Thereby, the impedance value of the signal transmission assembly 5 can be adjusted by using the first grounding metal layer 71 and the second grounding metal layer 72. For example, the distance (not labeled in the figure) between the first grounding metal layer 71 and the signal transmission line 51 and/or the distance (not labeled in the figure) between the second grounding metal layer 72 and the signal transmission line 51 can be utilized to adjust the impedance value of the signal transmission assembly 5. It should be noted that only a portion of the substrate S, a portion of the signal transmission line 51, and a portion of the grounding metal member 7 are shown in FIG. 4, so that the architecture of the GCPW can be easily presented in the figure. Further, in order to better present the figure, the feed-in element F is not shown in FIG. 5.

Referring again to FIG. 3 to FIG. 5, for example, a via hole V may be provided on the substrate S, and the via hole V may be coupled to the first grounding metal layer 71 and the third grounding metal layer 73 such that the first grounding metal layer 71 and the third grounding metal layer 73 are coupling to each other. In addition, the via hole V can be coupled to the second grounding metal layer 72 and the third grounding metal layer 73 such that the second grounding metal layer 72 and the third grounding metal layer 73 are coupling to each other. It should be noted that the technique of providing electrical conductors in the via hole V to electrically connect the components respectively disposed on opposite surfaces is well known to those skilled in the art and is not described herein. In other embodiments, the via hole V may be replaced by a conductive pillar, and the present disclosure is not limited in this aspect.

Referring again to FIG. 3, the signal transmission line 51 and the first radiating element 1 are connected in series to each other to form a first conductive path P1. The feeding end F1 of the feed-in element F can be coupled to the signal transmission line 51 at a feed point (not labeled); that is, the coupling position between the feeding end F1 and the signal transmission line 51 can be defined as a feed point. In addition, the first conductive path P1 may extend from the feed point to the first radiating element 1. In addition, the first impedance matching circuit 52 can include a first capacitor 521 and a first inductor 522. The first capacitor 521 can be connected in series to the first conductive path P1. The first inductor 522 can be coupled to the first conductive path P1 and the grounding member 6. In addition, for example, the first capacitor 521 can have a capacitance value between 0.1 picofarads (pF) and 20 pF, and the first inductor 522 can have an inductance value between 1 nanohenry (nH) and 30 nH. However, the present disclosure is not limited thereto. It should be noted that, in other embodiments, the first impedance matching circuit 52 may be a π-type circuit or a T-type circuit, such that the first impedance matching circuit 52 is coupled between the first radiating element 1, the signal transmission line 51 and the grounding member 6.

In addition, for example, the first radiating element 1 may have a first operating frequency band with a frequency range between 1710 MHz and 2690 MHz, and the second radiating element 2 may have a second operating frequency band with a frequency range between 698 MHz and 960 MHz. However, the present disclosure is not limited thereto. Thereby, the impedance matching of the first radiating element 1 can be adjusted by the first impedance matching circuit 52. The first impedance matching circuit 52 also has a filtering function to prevent the signal of the second radiating element 2 from affecting the signal of the first radiating element 1; that is, preventing the low frequency signal from affecting the high frequency signal. In addition, for example, the first impedance matching circuit 52 can be a high-pass circuit, and the filter 54 can be a low-pass circuit. The filter 54 can be, for example, but not limited to being, an inductor. However, the present disclosure is not limited thereto. Thereby, the filter 54 can be adopted to prevent the signal of the first radiating element 1 from affecting the signal of the second radiating element 2. In other words, the filter 54 can be used to filter out frequencies above 1000 MHz to prevent high frequency signals from affecting low frequency signals.

Second Embodiment

Figure 6:
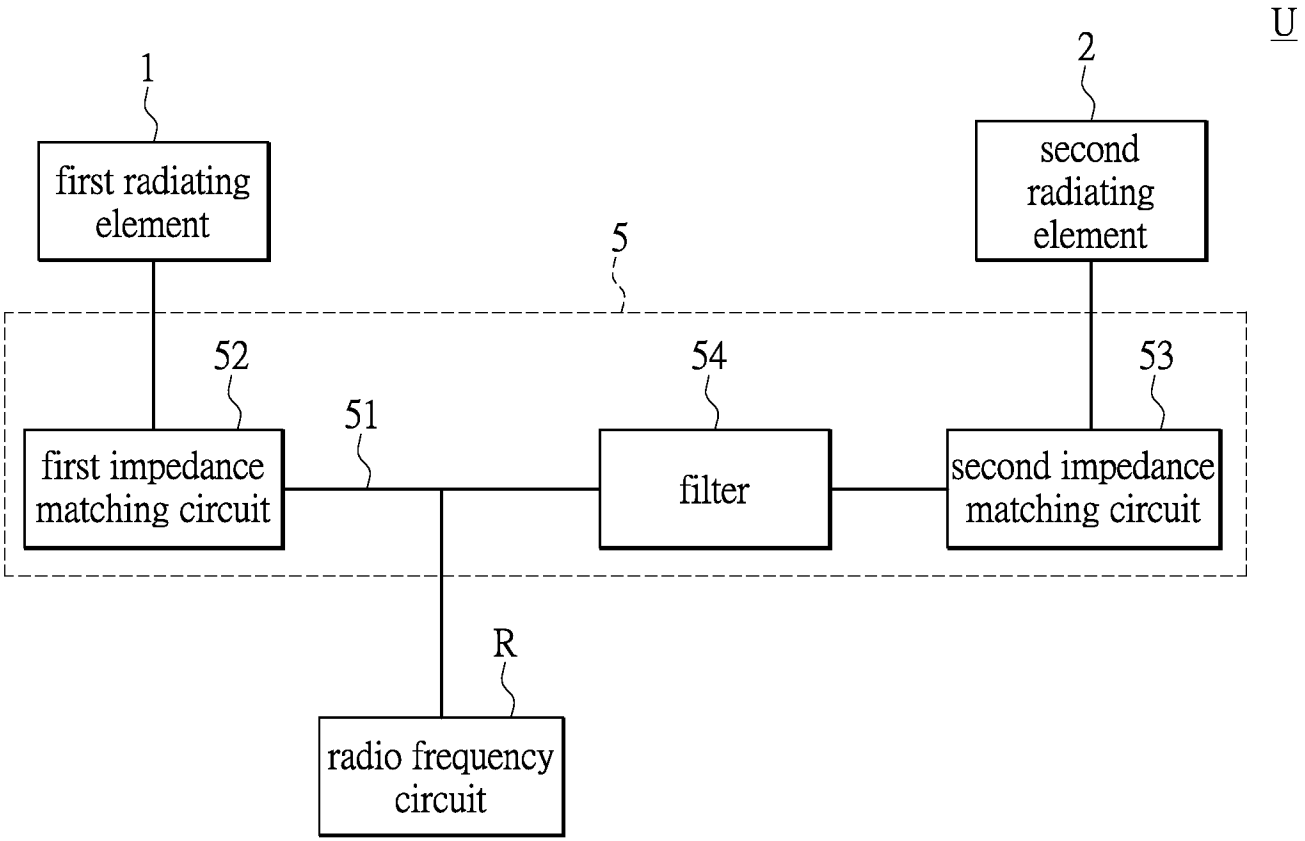
FIG. 6 is a functional block diagram of the antenna structure according to a second embodiment of the present disclosure.
Figure 7:
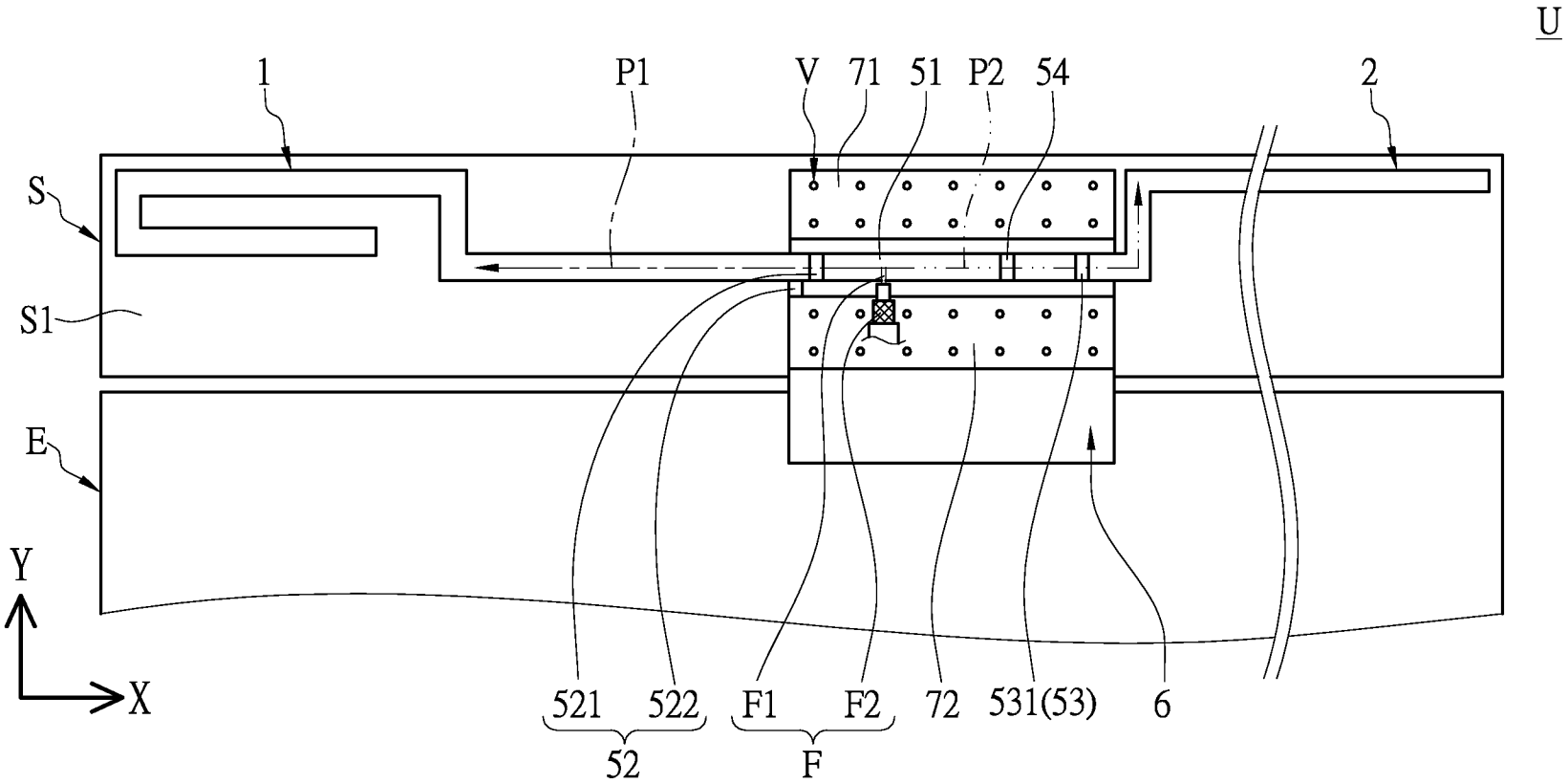
FIG. 7 is a top view of the antenna structure according to the second embodiment of the present disclosure.

First, reference is made to FIG. 6 and FIG. 7. FIG. 6 is a functional block diagram of the antenna structure U according to a second embodiment of the present disclosure. FIG. 7 is a top view of the antenna structure U according to the second embodiment of the present disclosure. A comparison between FIG. 6 and FIG. 1 shows that one of the differences between the second embodiment and the first embodiment is that the signal transmission assembly 5 can further include a second impedance matching circuit 53, and the second impedance matching circuit 53 can be coupled between the second radiating element 2 and the filter 54. In addition, other structural features shown in the second embodiment that are similar to those in the foregoing embodiment are not described herein for brevity.

Referring again to FIG. 6 and FIG. 7, the signal transmission line 51, the filter 54 and the second radiating element 2 may be connected in series to each other to form a second conductive path P2. The second conductive path P2 may extend from the feed point to the second radiating element 2. In addition, the second impedance matching circuit 53 may include a second capacitor 531, and the second capacitor 531 may be connected in series to the second conductive path P2. For example, the second capacitor 531 can have a capacitance value between 0.1 pF and 20 pF, but the present disclosure is not limited thereto.

Figure 8:
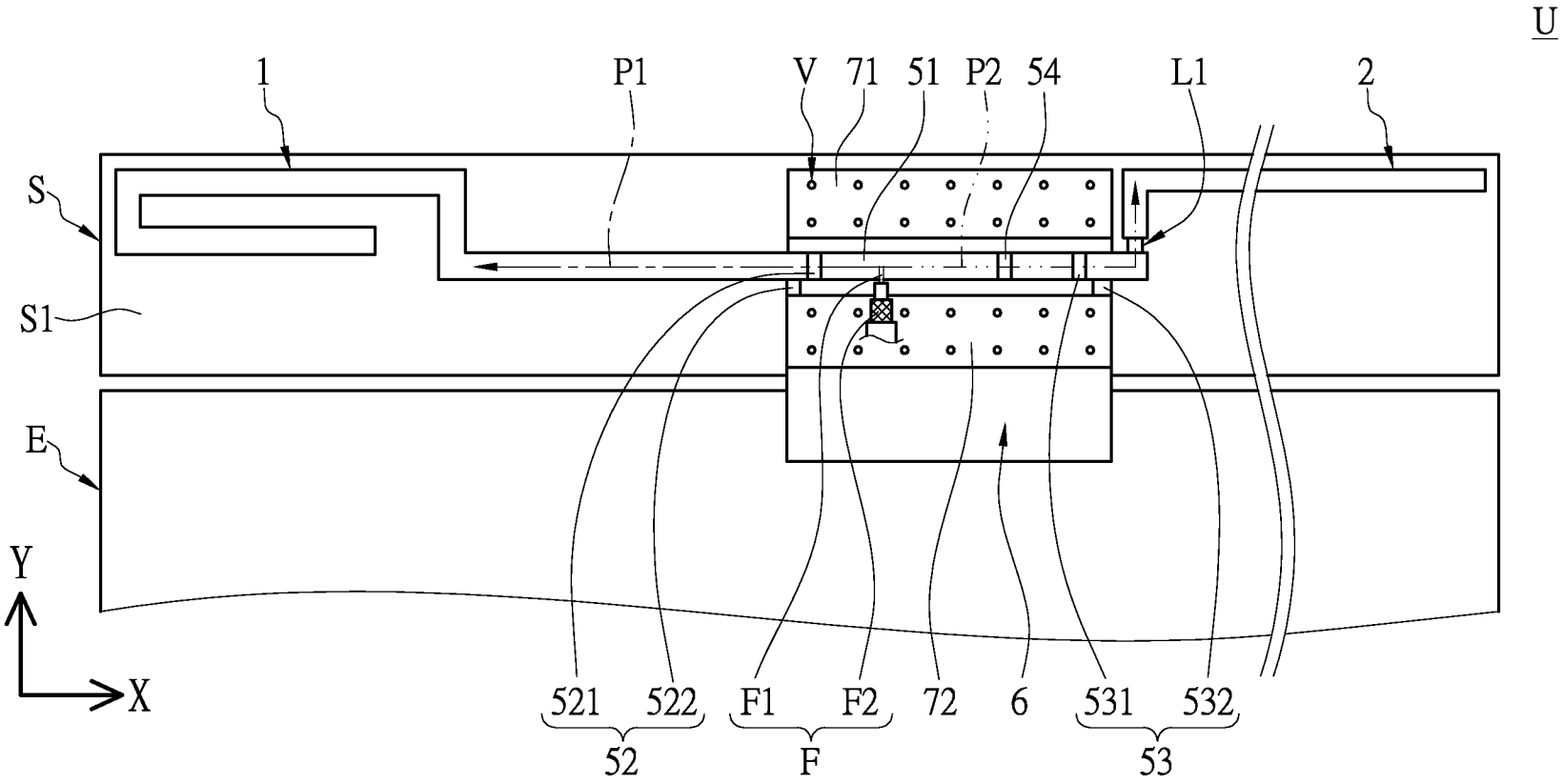
FIG. 8 is another top view of the antenna structure according to the second embodiment of the present disclosure.

Next, reference is made to FIG. 8. FIG. 8 is another top view of the antenna structure U according to the second embodiment of the present disclosure. As shown by a comparison between FIG. 8 and FIG. 7, in the embodiments of FIG. 8, the second impedance matching circuit 53 further includes a second inductor 532, and the second inductor 532 can be coupled between the second conductive path P2 and the grounding member 6. For example, the second inductor 532 can have an inductance value between 1 nH and 30 nH, but the present disclosure is not limited thereto. It should be noted that in other embodiments, the second impedance matching circuit 53 can be a π-type circuit or a T-type circuit, so that the second impedance matching circuit 53 is coupled between the second radiating element 2, the filter 54 and the grounding members 6.

Referring again to FIG. 8, the antenna structure U may further include a first inductance element L1. The first inductance element L1 may be disposed on the substrate S, and the first inductance element L1 may be coupled to the second radiating element 2. For example, the first inductance element L1 may have an inductance value between 1 nH and 30 nH, but the present disclosure is not limited thereto. Further, by adjusting the inductance value of the first inductance element L1, the center frequency of the second operation frequency band can be adjusted. It should be noted that the second impedance matching circuit 53 and the first inductance element L1 can be selectively adopted, and the present disclosure is not limited to the second impedance matching circuit 53 and the first inductance element L1 being adopted together. That is, the first inductance element L1 can be selectively adopted and is not limited to being provided in the antenna structure U of the present disclosure.

Figure 9:
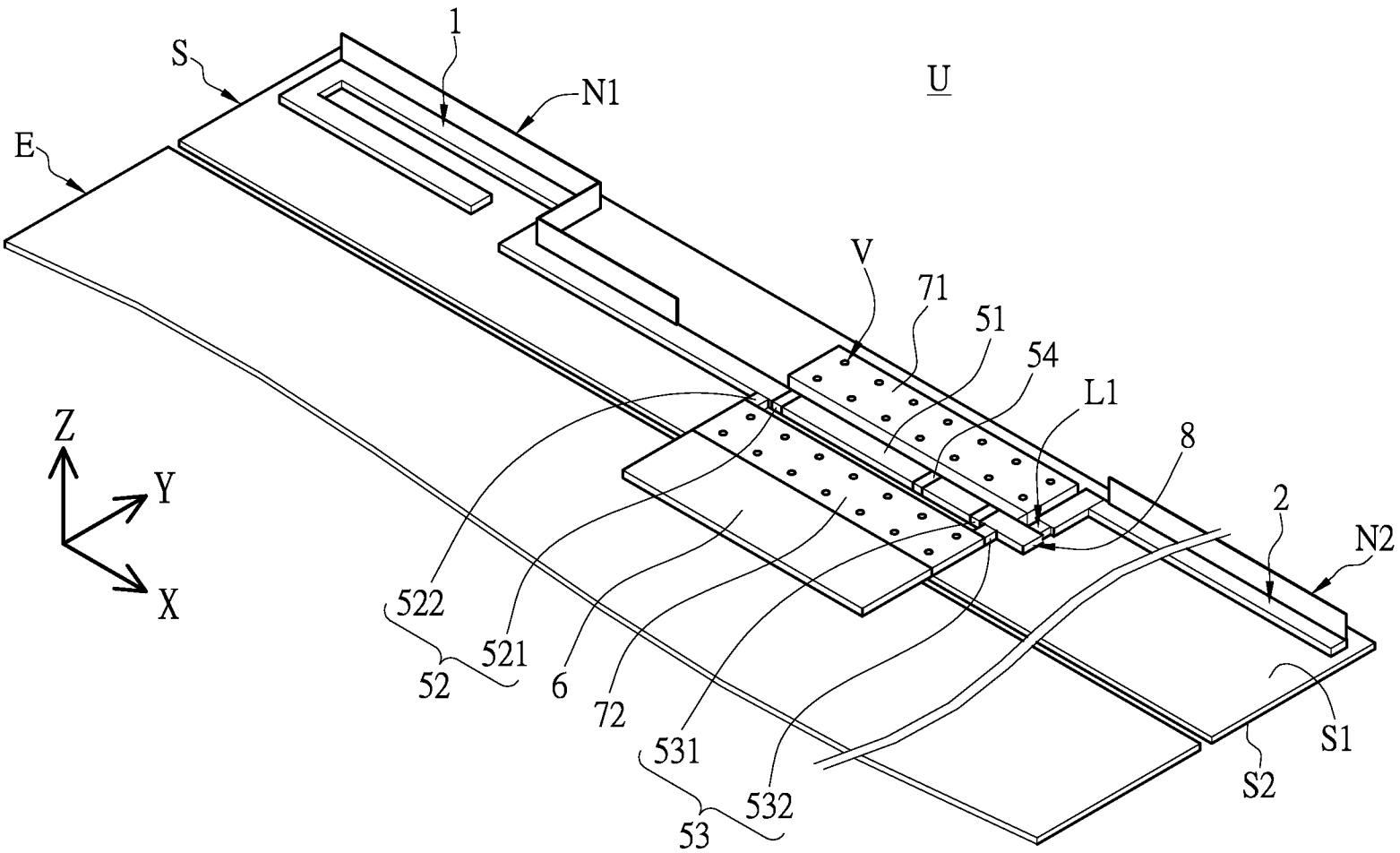
FIG. 9 is a perspective view of the antenna structure according to the second embodiment of the present disclosure.

Reference is made to FIG. 9, which is a perspective view of the antenna structure U according to the second embodiment of the present disclosure. It can be seen from a comparison between FIG. 9 and FIG. 8 that the antenna structure U can also include a first conductive metal member N1 and a second conductive metal member N2. The first conductive metal member N1 is coupling to the first radiating element 1 and perpendicular to the first radiating element 1. The second conductive metal member N2 is coupling to the second radiating element 2 and perpendicular to the second radiating element 2. In addition, the first conductive metal member N1 and the second conductive metal member N2 may be disposed along the peripheral contours of the first radiating element 1 and the second radiating element 2, respectively. Thereby, the radiation efficiency (such as but not limited to gain) and/or the bandwidth of the first radiating element 1 and the second radiating element 2 can be respectively enhanced by the first conductive metal piece N1 and the second conductive metal piece N2.

Third Embodiment

Figure 10:
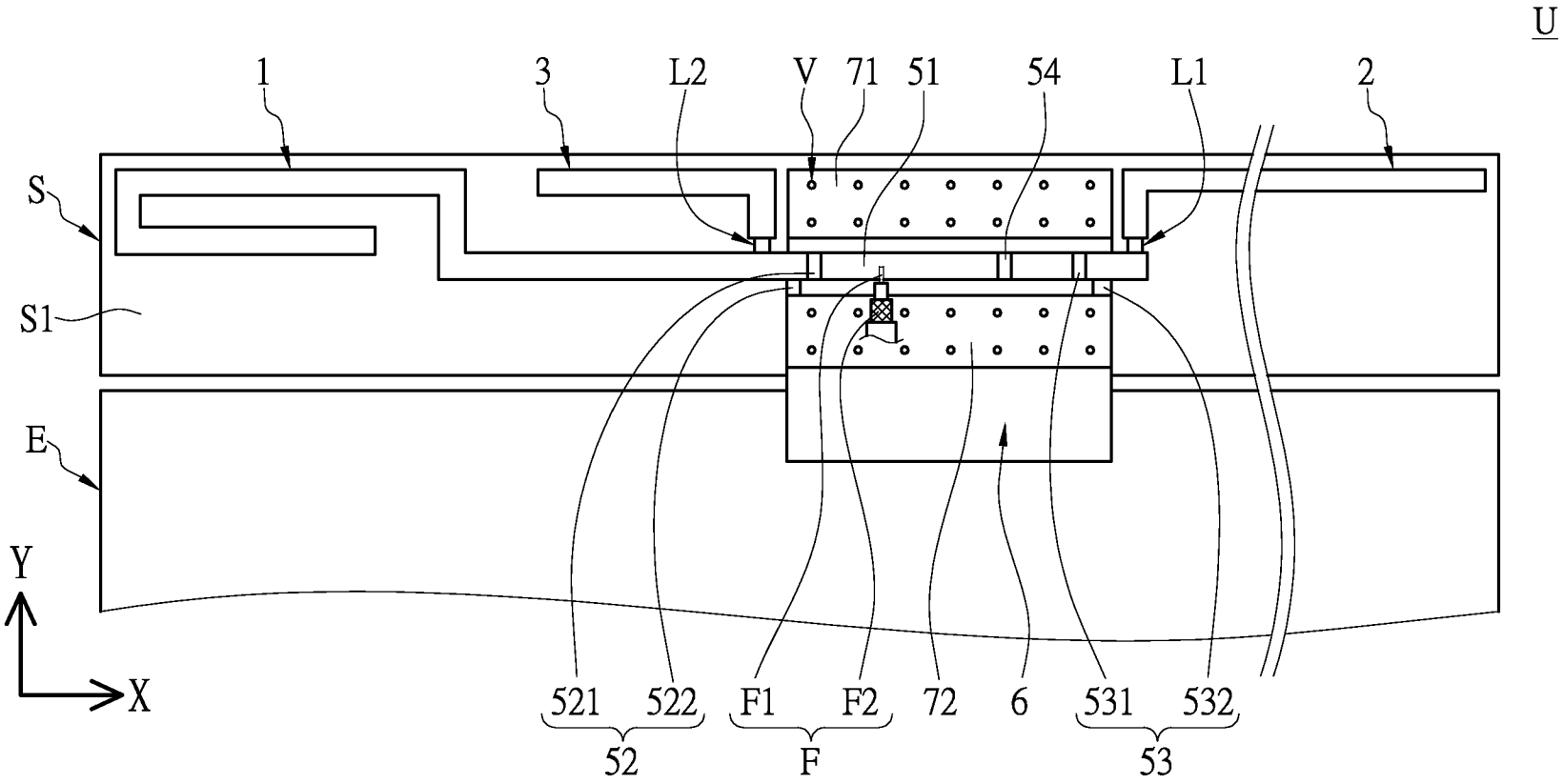
FIG. 10 is a top view of the antenna structure according to a third embodiment of the present disclosure.

Reference is made to FIG. 10, which is a top view of the antenna structure U according to a third embodiment of the present disclosure. As can be seen from a comparison between FIG. 10 and FIG. 8, one of the differences between the third embodiment and the second embodiment is that the antenna structure U can further include a third radiating element 3 to provide a third operating frequency band. Further, the third radiating element 3 can be disposed on the substrate S and coupling to the first radiating element 1. The third radiating element 3 can have a third operating frequency band with a frequency range from 5150 MHz to 5850 MHz. In addition, the third radiating element 3 can be a metal piece, a metal wire or other conductive bodies having a conductive effect, but the present disclosure is not limited thereto. In certain embodiments, the material of the third radiating element 3 is the same as that of the first radiating element 1. In addition, other structural features shown in the third embodiment that are similar to those of the foregoing embodiments are not described herein for brevity.

Referring again to FIG. 10, the third radiating element 3 can be coupled to the signal transmission assembly 5 by being coupled to the first radiating element 1. In certain embodiments, the antenna structure U further includes a second inductance element L2. The second inductance element L2 can be disposed on the substrate S, and be coupled between the third radiating component 3 and the first radiating element 1. For example, the second inductance element L2 may have an inductance value between 1 nH and 30 nH, but the present disclosure is not limited thereto. Further, by adjusting the inductance value of the second inductance element L2, the center frequency of the third operation frequency band can be adjusted. It should be noted that the second inductance element L2 can be selectively provided and is not limited to being provided in the antenna structure U of the present disclosure.

Figure 11:
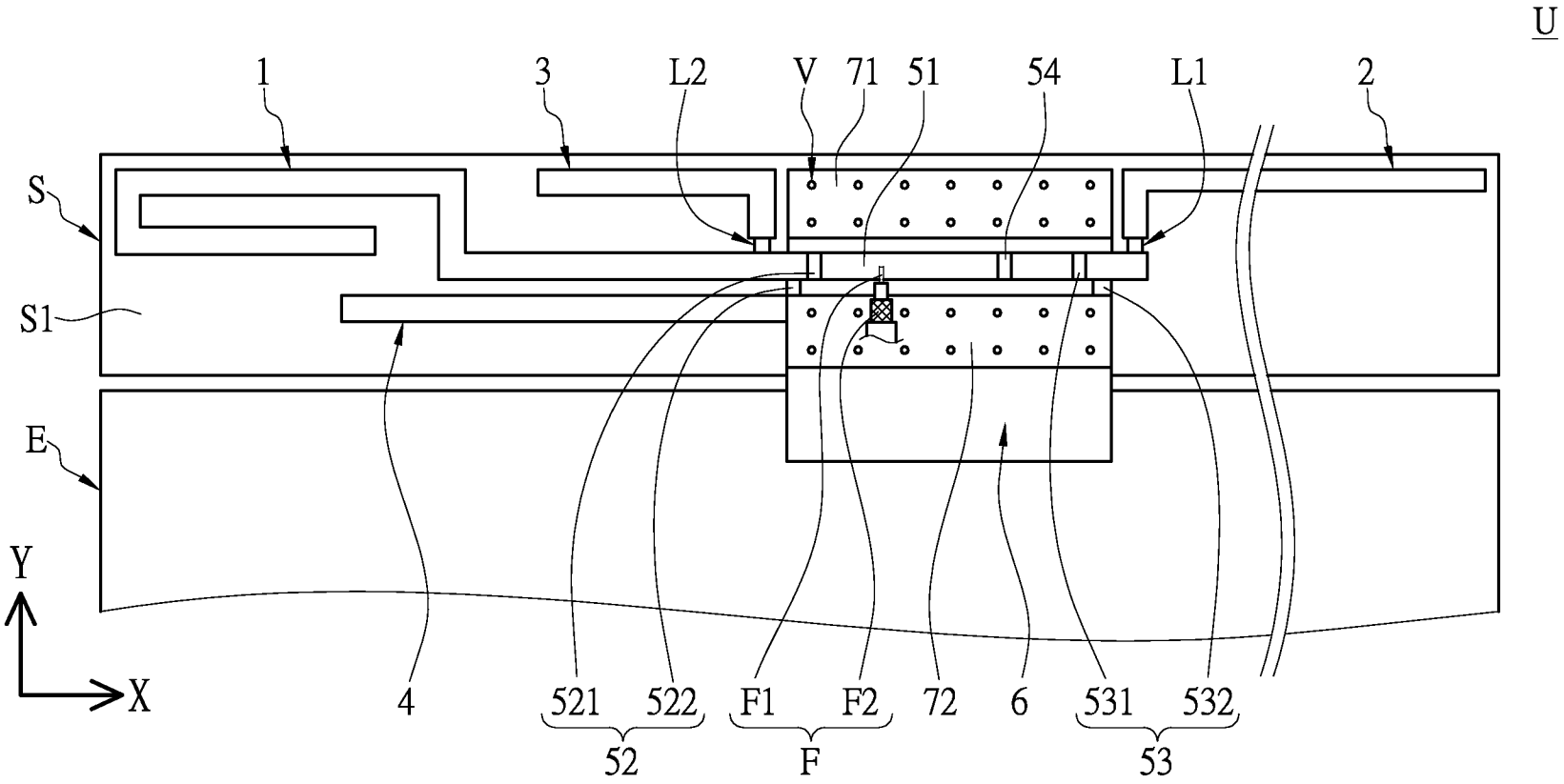
FIG. 11 is another top view of the antenna structure according to the third embodiment of the present disclosure.

Reference is made to FIG. 11, which is another top view of the antenna structure according to the third embodiment of the present disclosure. As can be seen from a comparison between FIG. 11 and FIG. 10, in the embodiments of FIG. 10, the antenna structure U may further include a parasitic element 4 to provide a fourth operating frequency band. Further, the parasitic element 4 can be disposed on the substrate S and coupling to the grounding member 6. Furthermore, the parasitic element 4 and the first radiating element 1 are separated from each other and coupling to each other to produce a fourth operating frequency band having a frequency range between 3400 MHz and 3800 MHz. In other words, the fourth operating frequency band can be generated by the coupling of the parasitic element 4 to the first radiating element 1. In addition, for example, the parasitic element 4 can be coupled to the second grounding metal layer 72 and coupling to the grounding member 6 through the second grounding metal layer 72, but the present disclosure is not limited thereto. It should be noted that the extension length of the parasitic element 4 is inversely proportional to the center frequency of the fourth operating frequency band. That is, the longer the extension length of the parasitic element 4 is, the lower the center frequency of the fourth operating frequency band is, and the shorter the extension length of the parasitic element 4 is, the higher the center frequency of the fourth operating frequency band is. Thereby, in the embodiments of FIG. 11, the antenna structure U can simultaneously have a first operating frequency band ranging between 1710 MHz and 2690 MHz, a second frequency band ranging between 698 MHz and 960 MHz, a third operating frequency band ranging between 5150 MHz and 5850 MHz, and a fourth operating frequency band ranging between 3400 MHz and 3800 MHz.

Figure 12:
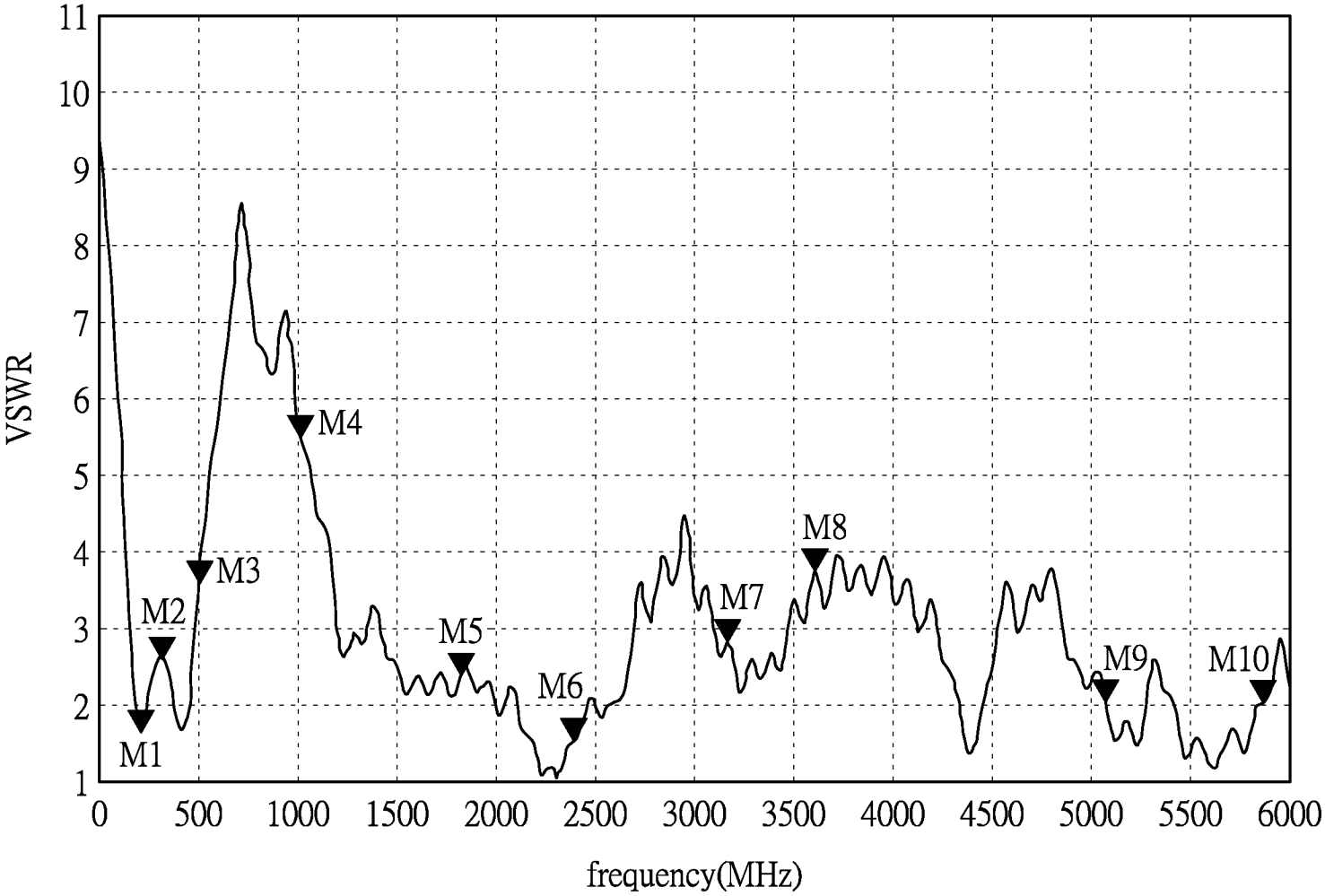
FIG. 12 is a graph showing the voltage standing wave ratio (VSWR) of the antenna structure of FIG. 11 at different frequencies.

Reference is made to FIG. 12 and Table 1 below. FIG. 12 is a graph showing the VSWR of the antenna structure U of FIG. 11 at different frequencies.

TABLE 1

| Node | Frequency (MHz) | VSWR |
|---|---|---|
| M1 | 698 | 1.66 |
| M2 | 791 | 2.62 |
| M3 | 960 | 3.60 |
| M4 | 1425 | 5.48 |
| M5 | 2170 | 2.41 |
| M6 | 2690 | 1.54 |
| M7 | 3400 | 2.79 |
| M8 | 3800 | 3.68 |
| M9 | 5150 | 2.04 |
| M10 | 5875 | 1.96 |

Figure 13:
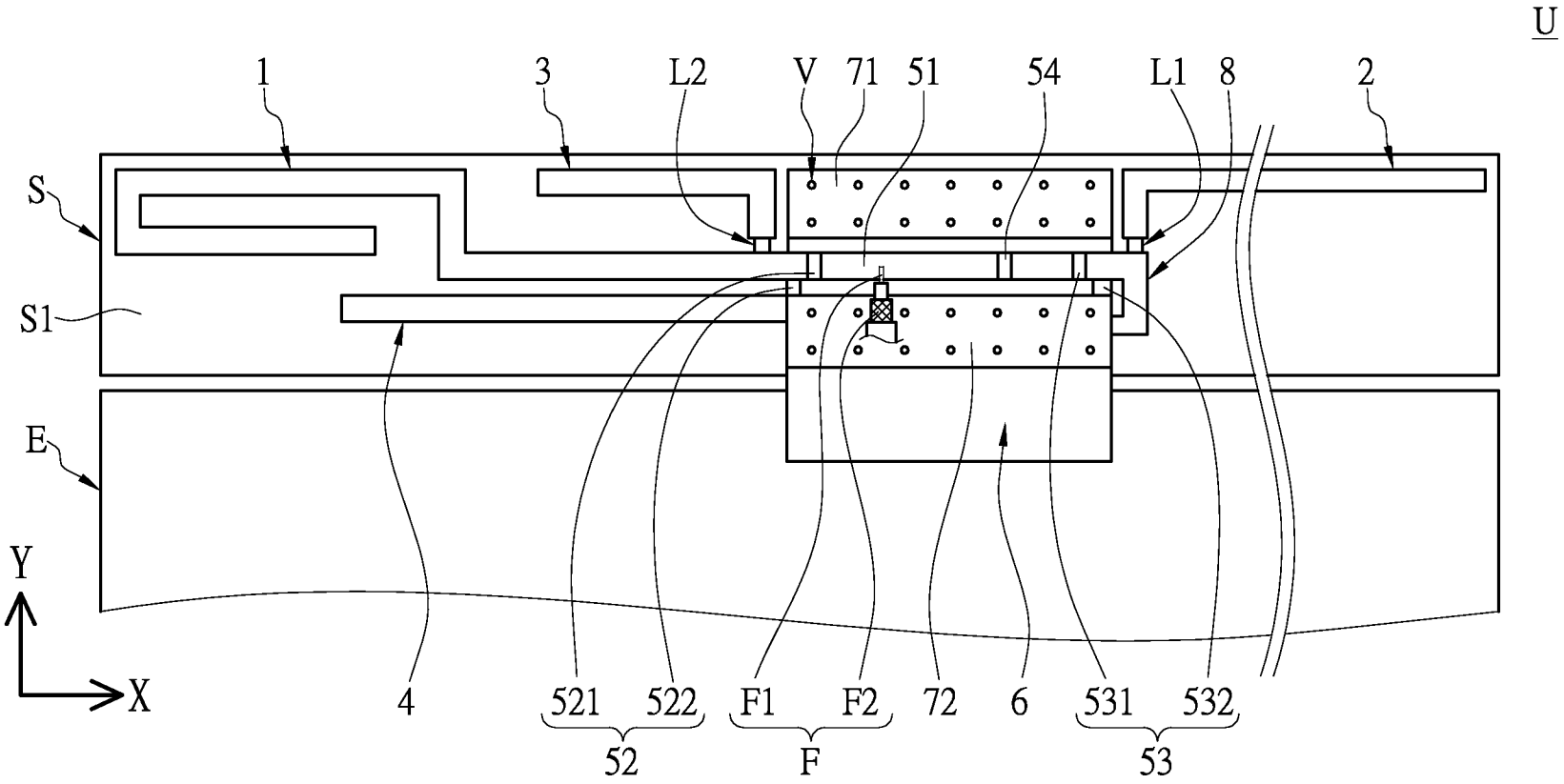
FIG. 13 is yet another top view of the antenna structure according to the third embodiment of the present disclosure.

Reference is made to FIG. 13, which is another top view of the antenna structure U according to the third embodiment of the present disclosure. It can be seen from a comparison between FIG. 13 and FIG. 11 that in the embodiment of FIG. 13, the antenna structure U can further include a grounding conductive member 8. One end of the grounding conductive member 8 can be coupled between the second radiating element 2 and the signal transmission assembly 5, and the other end of the grounding conductive member 8 can be coupled to the grounding member 6 to form a ground short circuit path. Thereby, the ground short circuit path formed by the grounding conductors 8 can adjust the impedance value corresponding to the center frequency of the second operating frequency band.

Figure 14:
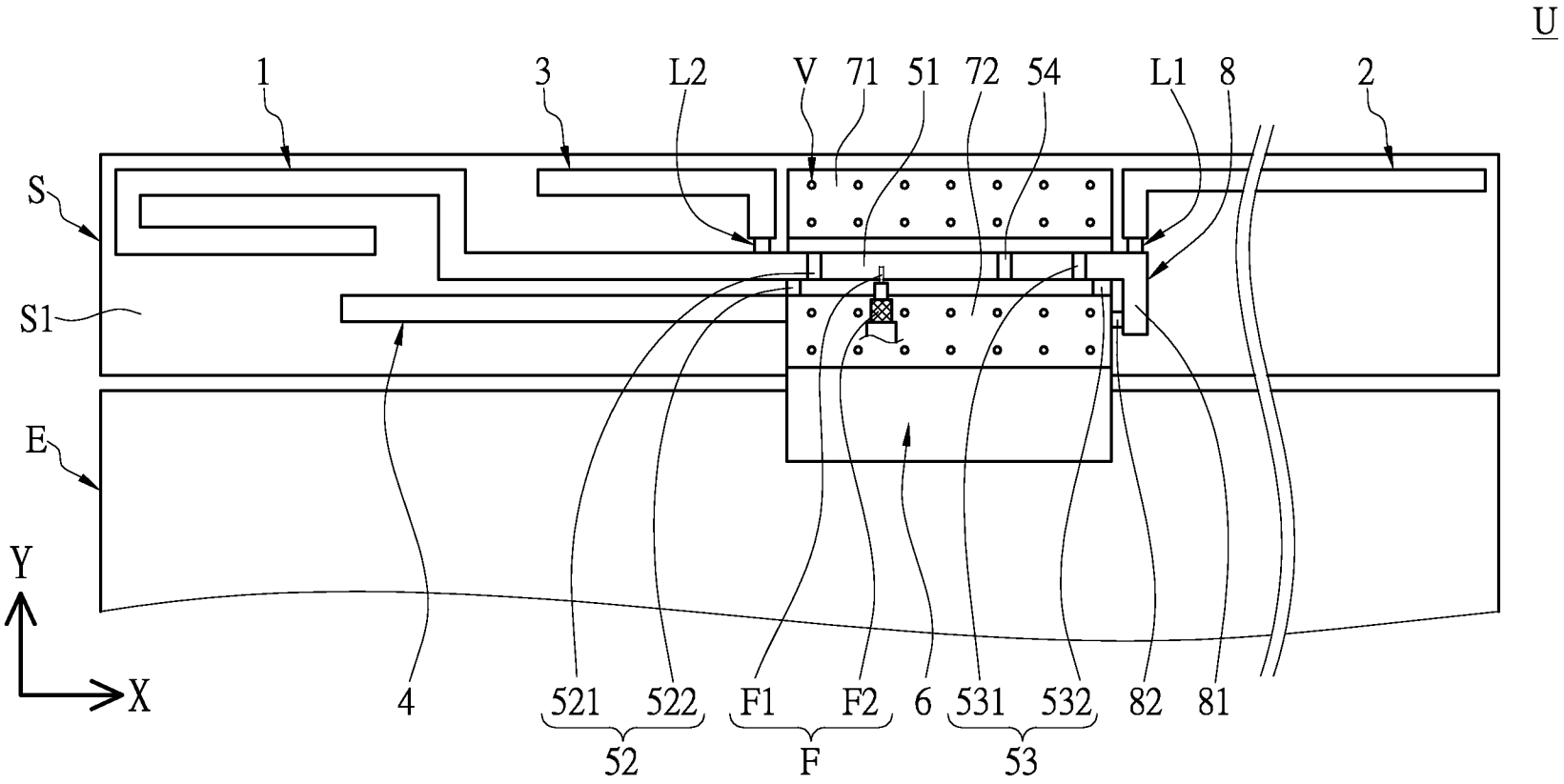
FIG. 14 is still another top view of the antenna structure according to the third embodiment of the present disclosure.

Reference is made to FIG. 14, which is another top view of the antenna structure U according to the third embodiment of the present disclosure. As shown by the comparison between FIG. 14 and FIG. 13, in the embodiments of FIG. 14, the grounding conductive member 8 can include a grounding conductive body 81 and a third inductor 82 coupling to the grounding conductive body 81. In other words, in the embodiment of FIG. 13, the grounding conductor 8 includes only the grounded conductive body 81 (not labeled in FIG. 13). In addition, by further providing the third inductor 82, the impedance value corresponding to the center frequency of the second operating frequency band can be adjusted by adjusting the inductance value of the third inductor 82. For example, the third inductor 82 can have an inductance value between 1 nH and 30 nH, but the present disclosure is not limited thereto. Thereby, by further providing the third inductor 82, the extension length of the grounding conductive body 81 can be prevented from becoming excessively long.

Fourth Embodiment

Figure 15:
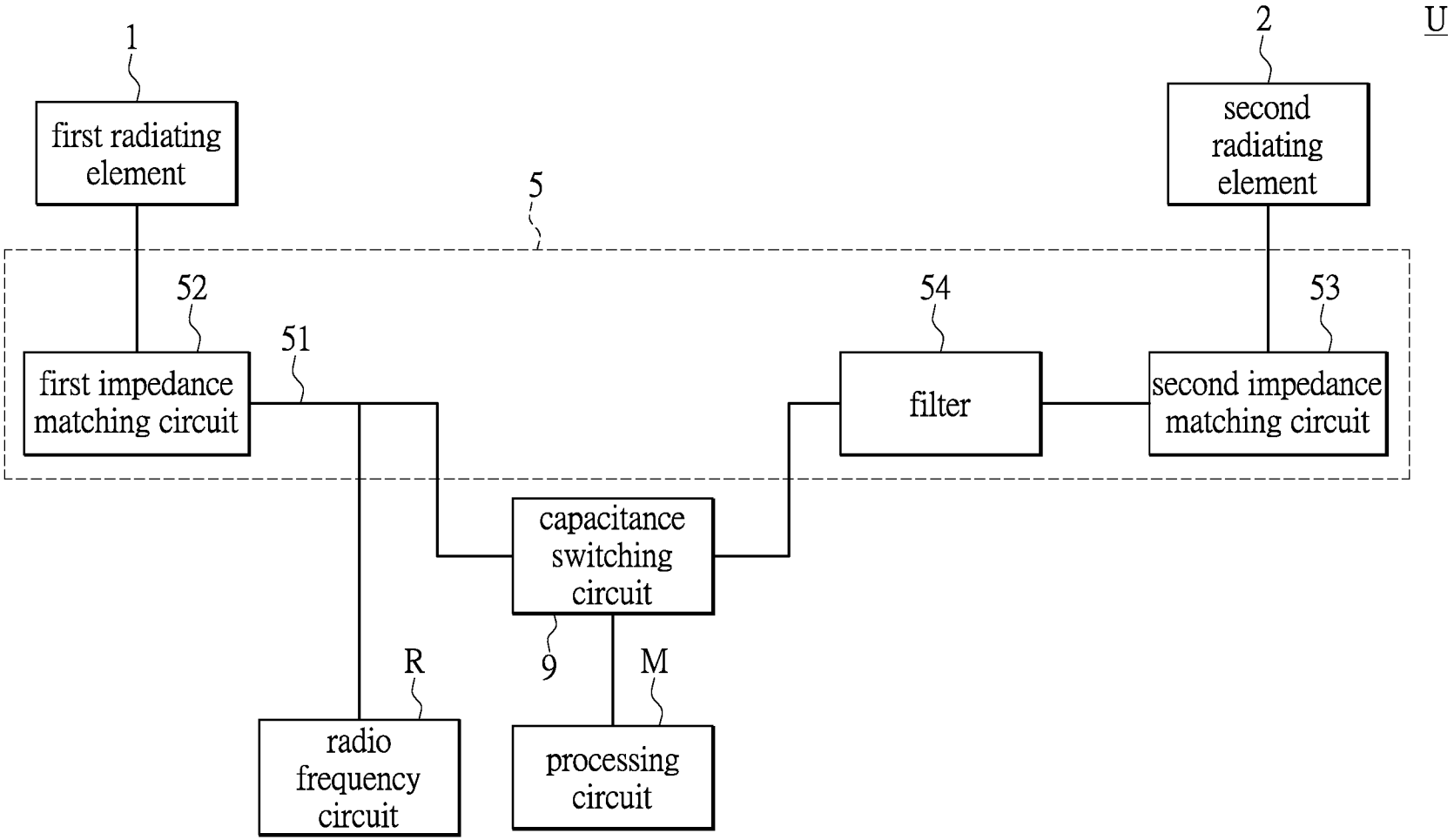
FIG. 15 is a functional block diagram of the antenna structure according to a fourth embodiment of the present disclosure.

Reference is made to FIG. 15, which is a functional block diagram of the antenna structure U according to a fourth embodiment of the present disclosure. It can be seen from a comparison between FIG. 15 and FIG. 6 that one of the differences between the fourth embodiment and the second embodiment is that the antenna structure U can further include a capacitance switching circuit 9 (such as but not limited to a tuner IC for tuning capacitance or a switch IC for switching different capacitances). The capacitance switching circuit 9 can be coupled between the feed-in element F and the filter 54. Further, the capacitance switching circuit 9 can be coupled between the feed point between the feeding end F1 and the signal transmission line 51 and the second radiating element 2. In certain embodiments, the capacitance switching circuit 9 can be coupled between the feed point between the feeding end F1 and the signal transmission line 51 and the filter 54. It should be noted that the capacitance switching circuit 9 can be disposed in the non-clearance area, and the capacitance switching circuit 9 can adjust the impedance value of the signal transmission assembly 5.

When the capacitance switching circuit 9 switches to a first capacitance value, the antenna structure U can operate in a fourth operating frequency band. When the capacitance switching circuit 9 switches to a second capacitance value, the antenna structure U can operate in a fifth operating frequency band. The center frequency of the fourth operating frequency band may be lower than the center frequency of the fifth operating frequency band, and the first capacitance value may be greater than the second capacitance value.

For example, the capacitance switching circuit 9 can adjust the center frequency of the second operating frequency band, but the present disclosure is not limited thereto. Further, the frequency range of the second operating frequency band may be between 698 MHz and 960 MHz, and may include a first frequency band range of 698 MHz to 791 MHz, and a second frequency band range between 791 MHz and 960 MHz. In certain embodiments, a low frequency range (first frequency band range) of the second operating frequency band may be a fourth operating frequency band, and a high frequency range (second frequency band range) of the second operating frequency band may be the fifth operating frequency band, but the present disclosure is not limited thereto. In addition, for example, the first capacitance value may be 8.2 pF, and the second capacitance value may be 6.8 pF, but the present disclosure is not limited thereto. Thereby, the second operating frequency band can be switched to the first frequency band range between 698 MHz and 791 MHz by switching the capacitance switching circuit 9 to the first capacitance value, so as to comply with the U.S.-specified operating frequency band. In addition, the second operating frequency band can be switched to a second frequency band between 791 MHz and 960 MHz by switching the capacitance switching circuit 9 to the second capacitance value, so as to comply with the European operating frequency band. In other words, the effect of band switching can be achieved by switching between the first capacitance value and the second capacitance value.

Referring again to FIG. 15, the antenna structure U may further include a processing circuit M (processor). The capacitor switching circuit 9 may be coupled to the processing circuit M, and the capacitor switching circuit 9 may be controlled by the processing circuit M to switch between the first capacitance value and the second capacitance value.

Therefore, the antenna structure U provided by the present disclosure can not only achieve a multi-band effect with a single feed-in element F, but also reduce the overall area of the antenna structure U and improve the radiation performance (such as gain) of the antenna by the technical features of "a signal transmission line 51 coupled between the first radiating element 1 and the second radiating element 2," "a first impedance matching circuit 52 coupling to the first radiating element 1 and the signal transmission line 51," "a filter 54 coupling to the second radiating element 2 and the signal transmission line 51," and "the feed-in element F coupled between the signal transmission line 51 and the grounding member 6." Thereby, an antenna structure U having a filtering function and an adjustable impedance can be formed.

Further, through "the first impedance matching circuit 52 is coupling to the first radiating element 1 and the signal transmission line 51," "the filter 54 is coupling to the second radiating element 2 and the signal transmission line 51," and "the second impedance matching circuit 53 is coupling to the second radiating element 2 and filter 54," the influence between different frequency bands is avoided, and thus the matching effect of the antenna structure U is improved.

The foregoing description of the exemplary embodiments of the present disclosure has been presented only for the purposes of illustration and description and is not intended to be exhaustive or to limit the present disclosure to the precise forms disclosed. Many modifications and variations are possible in light of the above teaching.

Certain embodiments were chosen and described in order to explain the principles of the present disclosure and their practical application so as to enable others skilled in the art to utilize the present disclosure and various embodiments and with various modifications as are suited to the particular use contemplated. Alternative embodiments will become apparent to those skilled in the art to which the present disclosure pertains without departing from its spirit and scope.

What is claimed is:

1. An antenna structure, comprising:

a substrate;

a first radiating element disposed on the substrate;

a second radiating element disposed on the substrate;

a signal transmission assembly disposed on the substrate and including:

a signal transmission line coupled between the first radiating element and the second radiating element;

a first impedance matching circuit coupling to the first radiating element and the signal transmission line; and a filter coupling to the second radiating element and the signal transmission line;

a grounding member; and a feed-in element coupled between the signal transmission line and the grounding member.

2. The antenna structure according to claim 1, wherein the signal transmission line and the first radiating element are connected in series to form a first conductive path, the first impedance matching circuit includes a first capacitor connected in series to the first conductive path, and a first inductor coupled between the first conductive path and the grounding member.

3. The antenna structure according to claim 2, wherein the first capacitor has a capacitance value between 0.1 pF and 20 pF, and the first inductor has an inductance value between 1 nH and 30 nH.

4. The antenna structure according to claim 1, wherein the signal transmission line, the filter and the second radiating element are connected in series to each other to form a second conductive path, the signal transmission assembly further includes a second impedance matching circuit coupled between the filter and the second radiating element and including a second capacitor connected in series to the second conductive path.

5. The antenna structure according to claim 4, wherein the second impedance matching circuit further includes a second inductor coupled between the second conductive path and the grounding member.

6. The antenna structure according to claim 5, wherein the second capacitor has a capacitance value between 0.1 pF and 20 pF, and the second inductor has an inductance value between 1 nH and 30 nH.

7. The antenna structure according to claim 1, further comprising:

a grounding metal member coupling to the grounding member and including:

a first grounding metal layer;

a second grounding metal layer; and a third grounding metal layer coupling to the first grounding metal layer and the second grounding metal layer, wherein the substrate has a first surface and a second surface opposite to the first surface, the signal transmission assembly, the first grounding metal layer and the second grounding metal layer are disposed on the first surface, and the third grounding metal layer is disposed on the second surface to form a grounded coplanar waveguide.

8. The antenna structure according to claim 1, wherein the first radiating element has a first operating frequency band with a frequency range between 1710 MHz and 2690 MHz, and the second radiating element has a second operating frequency band with a frequency range between 698 MHz and 960 MHz.

9. The antenna structure according to claim 1, further comprising a first inductance element coupling to the second radiating element.

10. The antenna structure according to claim 1, further comprising a third radiating element disposed on the substrate, coupling to the first radiating element and having a third operating frequency band with a frequency range from 5150 MHz to 5850 MHz.

11. The antenna structure according to claim 10, further comprising a second inductance element coupled between the third radiating element and the first radiating element.

12. The antenna structure according to claim 1, further comprising a parasitic element disposed on the substrate and coupling to the grounding member, wherein the parasitic element is separated from and coupling to the first radiating element to generate a fourth operating frequency band with a frequency range between 3400 MHz and 3800 MHz.

13. The antenna structure according to claim 1, further comprising a first conductive metal member and a second conductive metal member, wherein the first conductive metal member is coupling to and perpendicular to the first radiating element, and the second conductive metal member is coupling to and perpendicular to the second radiating element.

14. The antenna structure according to claim 1, further comprising a grounding conductive member having a first end coupled between the second radiating element and the signal transmission assembly, and a second end coupling to the grounding member.

15. The antenna structure according to claim 14, wherein the grounding conductive member has a grounding conductive body and a third inductor coupling to the grounding conductive body.

16. The antenna structure according to claim 1, further comprising a grounding metal member, wherein the substrate has a first surface and a second surface opposite to the first surface, the signal transmission assembly is disposed on the first surface, the grounding metal member is disposed on the second surface, and a vertical projection of the grounding metal member on the substrate overlaps at least partially with a vertical projection of the signal transmission assembly on the substrate.

17. The antenna structure according to claim 1, wherein the filter is an inductor.

18. The antenna structure according to claim 1, further comprising a capacitance switching circuit coupled between the feed-in element and the filter, wherein when the capacitance switching circuit switches to a first capacitance value, the antenna structure operates in a fourth operating frequency band, when the capacitance switching circuit switches to a second capacitance value, the antenna structure operates in a fifth operating frequency band, the fourth operating frequency band is lower than the fifth operating frequency band, and the first capacitance value is greater than the second capacitance value.

* * * * *